US007899372B2

(12) United States Patent
Hamada

(10) Patent No.: US 7,899,372 B2
(45) Date of Patent: Mar. 1, 2011

(54) DEVELOPING DEVICE AND IMAGE FORMING APPARATUS

(75) Inventor: Toshimasa Hamada, Kashihara (JP)

(73) Assignee: Sharp Kabushiki Kaisha, Osaka (JP)

( * ) Notice: Subject to any disclaimer, the term of this patent is extended or adjusted under 35 U.S.C. 154(b) by 123 days.

(21) Appl. No.: 12/346,907

(22) Filed: Dec. 31, 2008

(65) Prior Publication Data

US 2009/0175661 A1 Jul. 9, 2009

(30) Foreign Application Priority Data

Jan. 7, 2008 (JP) ..... 2008-000637

(51) Int. Cl.
*G03G 15/09* (2006.01)

(52) U.S. Cl. ..... 399/274

(58) Field of Classification Search ..... 399/274, 399/284, 53, 267, 270, 272
See application file for complete search history.

(56) References Cited

U.S. PATENT DOCUMENTS

| | | | | |
|---|---|---|---|---|
| 4,901,116 | A * | 2/1990 | Haneda et al. | 399/274 |
| 2007/0025777 | A1 * | 2/2007 | Tomita et al. | 399/274 |

FOREIGN PATENT DOCUMENTS

| | | | |
|---|---|---|---|
| JP | 60-131533 | A | 7/1985 |
| JP | 5-289522 | | 11/1993 |
| JP | 8-194376 | A | 7/1996 |
| JP | 2000-258992 | A | 9/2000 |
| JP | 2003-270923 | A | 9/2003 |
| JP | 2005-003889 | | 1/2005 |

* cited by examiner

*Primary Examiner* — David P Porta
*Assistant Examiner* — Kiho Kim
(74) *Attorney, Agent, or Firm* — Nixon & Vanderhye, PC

(57) ABSTRACT

A developing device for an image forming apparatus includes both a layer height restricting blade for controlling a thickness of the developer layer on a developer supply roller, and a spike-height restricting blade. The spike-height restricting blade is located downstream from the layer height restricting blade, and upstream from the position at which an electrostatic latent image bearing member and the developer supply roller are closest to each other. Preferably, the tip of the spike-height restricting blade is located downstream from a radial line along which a main magnetic pole of the device projects half of its maximum magnetic field strength.

17 Claims, 13 Drawing Sheets

FIG.8

| CIRCUMFERENTIAL VELOCIY RATIO | CONDITION OF DEVELOPING AGENT DURING FEEDING |
|---|---|
| 1.9 | × |
| 1.8 | ○ |
| 1.7 | ◎ |

DEVELOPING DEVICE AND IMAGE FORMING APPARATUS

CROSS REFERENCE

This Nonprovisional application claims priority under 35 U.S.C. §119(a) on Patent Application No. 2008-000637 filed in Japan on Jan. 7, 2008, the entire contents of which are hereby incorporated by reference.

BACKGROUND OF THE TECHNOLOGY

The technology relates to a developing device for use in an electrophotographic image forming apparatus of the type using a two-component developer comprising a toner and a carrier. More particularly, the technology relates to a developing device employing a counter developing system in which a developer bearing member feeds a developer at a developing region in a developer feeding direction which is opposite to an electrostatic latent image feeding direction in which an electrostatic latent image bearing member feeds an electrostatic latent image, as well as an image forming apparatus including such a developing device.

An electrophotographic image forming apparatus includes a developing device having a developer bearing member, and an electrostatic latent image bearing member for carrying an electrostatic latent image thereon. The developer bearing member supplies a developer to the peripheral surface of the electrostatic latent image bearing member at a developing region in which the electrostatic latent image bearing member and the developer bearing member face each other, to visualize the electrostatic latent image.

One developing system for such a developing device is a forward developing system in which the developer bearing member feeds the developer at the developing region in the same direction as the direction in which the electrostatic latent image bearing member feeds the electrostatic latent image, as described in Japanese Patent Laid-Open Publication No. H05-289522 for example.

With the forward developing system, when a high density region is developed in succession to development of a halftone region, a pinhole 201 is likely to occur in the halftone region as shown in FIG. 1. The pinhole 201 is considered to occur for the reason that electric flux lines 207 in a boundary area 206 of a halftone region 204 adjacent to a high density region 205 is deflected toward the high density region 205 as shown in FIG. 2 and, hence, an electric field is weakened in the boundary area 206.

With the forward developing system, after passage of the developer through the high density region 205, the amount of toner contained in the developer projecting like spikes is reduced, while an electric charge called "counter charge" appears at the tips of the spikes, whereby the developing ability of the developer is lowered. For this reason, the electrostatic latent image is more difficult to develop in the boundary area 206 in which the electric field is weakened, with the result that the pinhole 201 is likely to occur.

By contrast, with the counter developing system in which the developer feeding direction is opposite to the electrostatic latent image feeding direction of the electrostatic latent image bearing member, fresh spikes of the developer which have not passed through the developing region are applied to a downstream-side region of the electrostatic latent image bearing member 202 in the electrostatic latent image feeding direction. For this reason, the amount of toner contained in the developer is relatively large and the counter charge does not appear at the tips of the spikes. Therefore, the developing ability of the developer is relatively high in the boundary area 206, so that the pinhole 201 is less likely to occur in the halftone region 204 developed prior to the high density region 205.

With the counter developing system, however, a phenomenon so-called "sweeping together" that a trailing end portion of an image (i.e., an upstream end portion of the electrostatic latent image in the electrostatic latent image feeding direction) is developed excessively densely, is likely to occur.

The reason why such a phenomenon occurs is as follows. On the side upstream of a proximal position at which the electrostatic latent image bearing member and the developer bearing member are closest to each other in the direction of rotation of the developer bearing member, the developer projecting like spikes has not passed through the proximal position yet and, hence, spikes of the developer are relatively high. For this reason, the developer collides with the peripheral surface of the electrostatic latent image bearing member to cause toner particles to float. In the trailing end portion of the image located adjacent to an image-free portion, the density of electric flux lines directed from the peripheral surface of the developer bearing member toward the peripheral surface of the electrostatic latent image bearing member is likely to increase and, hence, floating toner particles collect easily. Further, since the side upstream of the proximal position at which the developer bearing member is closest to the electrostatic latent image in the developer feeding direction corresponds to the side downstream of the proximal position in the electrostatic latent image feeding direction, the quality of the image tends to be determined on the side downstream of the proximal position in the electrostatic latent image feeding direction. In a conventional image forming apparatus employing the counter developing system, floating toner particles are likely to collect on the trailing end portion of an image in a region in which the image quality tends to be determined.

The technology intends to provide a developing device which is capable of suppressing the occurrence of a pinhole in the halftone region developed prior to the high density region, as well as the occurrence of the phenomenon that the trailing end portion of an image becomes excessively dense.

SUMMARY OF THE TECHNOLOGY

According to the technology, there is provided a developing device for developing an electrostatic latent image carried on an electrostatic latent image bearing member rotating as to feed the electrostatic latent image at a developing region in a predetermined first direction. The developing device includes a developer bearing member, a magnetic field generating member, a layer thickness restricting member, and a spike-height restricting member. The developer bearing member has a cylindrical shape and is configured to feed a developer to a developing region in which the developer bearing member faces the electrostatic latent image bearing member by rotating in a second direction which is opposite to the first direction while carrying the developer on a peripheral surface thereof. The magnetic field generating member is unrotatably placed inside the developer bearing member and has a plurality of magnetic poles including a main magnetic pole positioned in the vicinity of the developing region. The layer thickness restricting member is configured to restrict a layer thickness of the developer born on the peripheral surface at a position upstream of the developing region in the second direction. The spike-height restricting member is placed at a predetermined position upstream of a proximal position at which the electrostatic latent image bearing member and the developer bearing member are closest to each other and downstream of the layer thickness restricting member in the second direction and is configured to restrict a spike height of the developer caused to project like spikes on the peripheral surface by a magnetic field generated by the main magnetic pole.

The foregoing and other features and attendant advantages of the technology will become more apparent from the reading of the following detailed description in conjunction with the accompanying drawings.

BRIEF DESCRIPTION OF THE DRAWINGS

FIG. 8 is a table showing the relationship between the circumferential velocity ratio obtained by dividing the linear velocity of the peripheral surface of the developing sleeve by the linear velocity of the peripheral surface of a photosensitive drum and the condition of the developer during feeding;

DETAILED DESCRIPTION OF THE TECHNOLOGY

Hereinafter, the best mode for carrying out the technology will be described with reference to the drawings.

Figure 1:
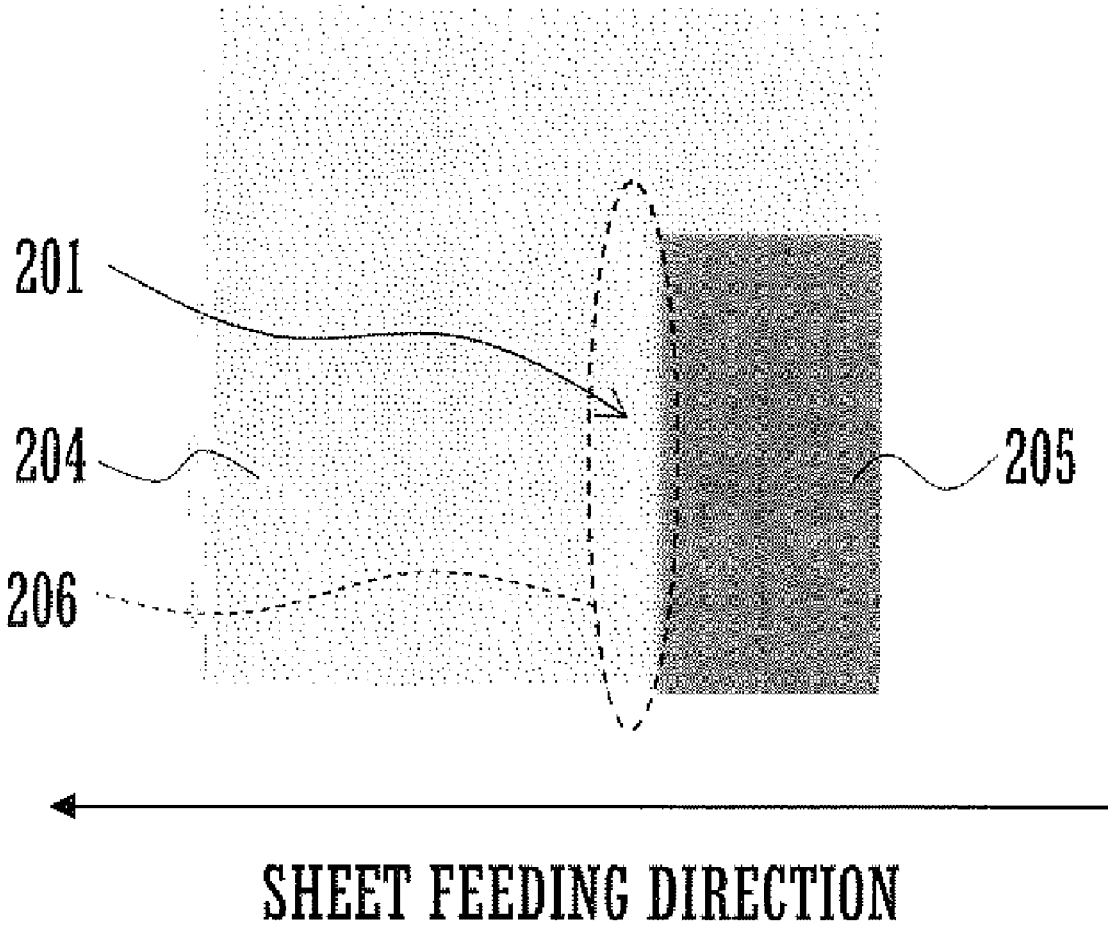
FIG. 1 is a view illustrating one exemplary pinhole.
Figure 2:
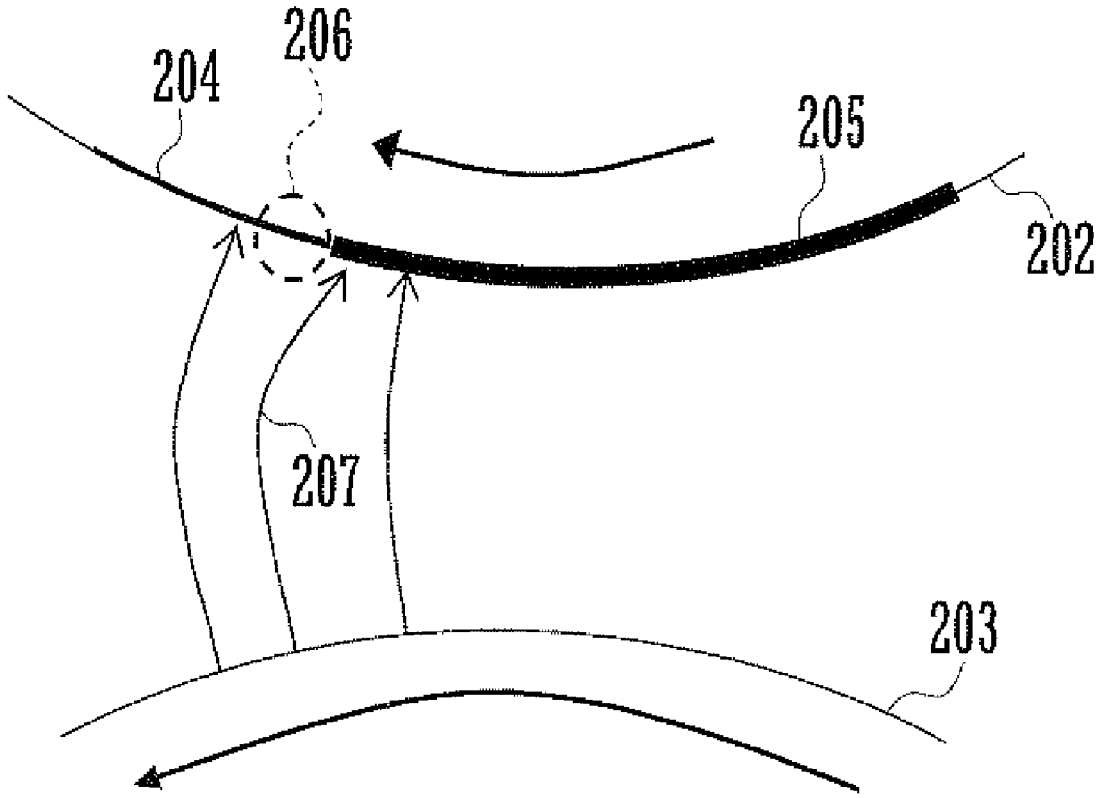
FIG. 2 is a view showing part of a conventional developing device including a developer bearing member facing an electrostatic latent image bearing member.
Figure 3:
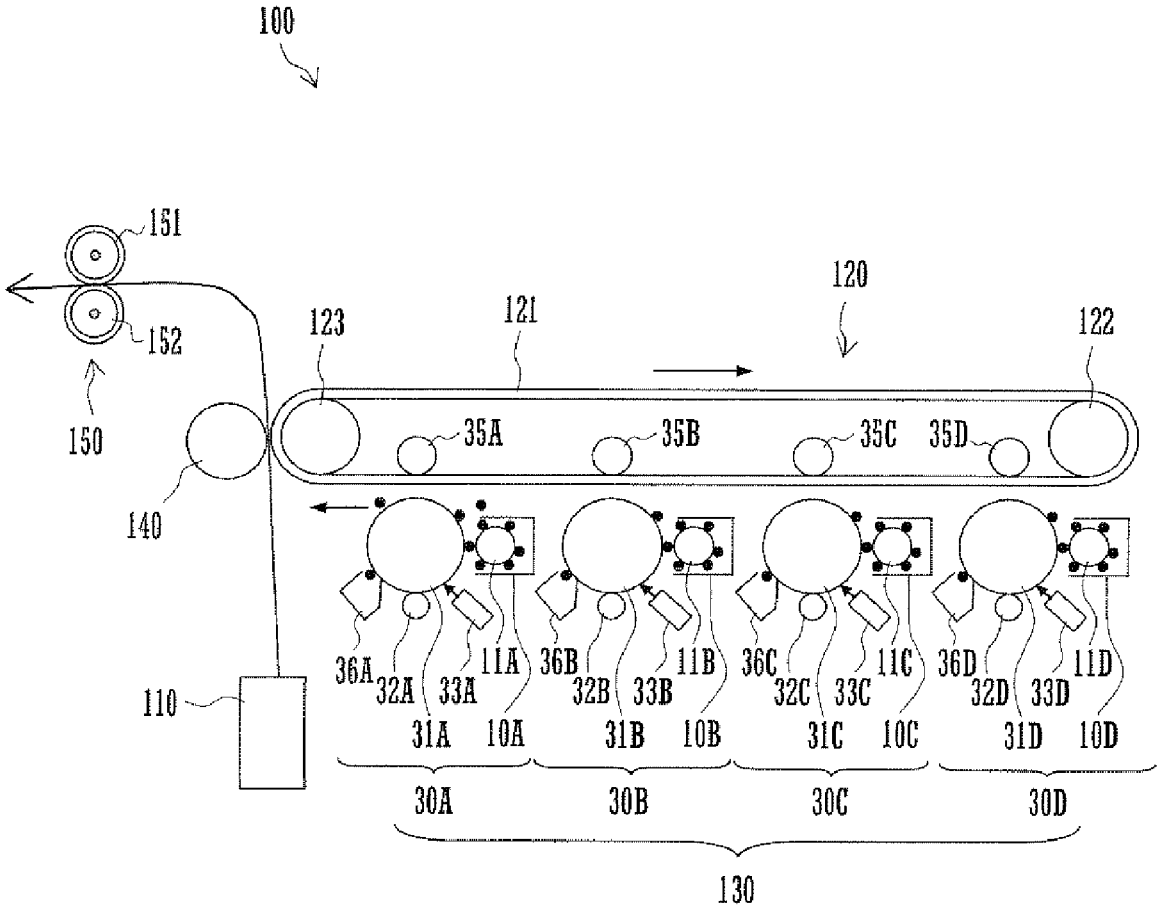
FIG. 3 is a sectional front elevational view schematically showing an image forming apparatus including a developing device.

FIG. 3 is a sectional front elevational view schematically showing an image forming apparatus 100 including a developing device. The image forming apparatus 100 is a tandem-type color image forming apparatus configured to form an image using four color developers for yellow, magenta, cyan and black. The color developers used in the image forming apparatus 100 are each a two-component developer comprising a toner and a carrier. The image forming apparatus 100 forms a color image or a monochrome image on a recording sheet as a recording medium according to image data read by a document reader or transmitted from terminal equipment, such as a PC (personal computer), connected thereto via a non-illustrated network.

The image forming apparatus 100 includes a sheet feeding tray 110, an intermediate transfer unit 120, an image forming unit 130, a secondary transfer roller 140, and a fixing device 150.

The sheet feeding tray 110 accommodates therein a multiplicity of recording sheets on each of which an image is to be formed.

The intermediate transfer unit 120 includes an intermediate transfer belt 121, a driving roller 122, and a driven roller 123. The intermediate transfer belt 121 is an endless belt entrained about the driving roller 122 and the driven roller 123 and rotates clockwise in FIG. 3.

The image forming unit 130 includes photosensitive drums 31A to 31D, electrostatic charger devices 32A to 32D, exposure units 33A to 33D, developing devices 10A to 10D, primary transfer rollers 35A to 35D, and cleaning units 36A to 36D. Each of the photosensitive drums 31A to 31B is equivalent to an electrostatic latent image bearing member. The developing devices 10A to 10D have developing rollers 11A to 11D, respectively.

The image forming unit 130 comprises four image forming sections 30A to 30D for forming an image using image data items corresponding to respective of four colors including the three subtractive primary colors: cyan, magenta and yellow, obtained by color separation of a color image, and black.

The image forming section 30A for black, image forming section 30B for cyan, image forming section 30C for magenta and image forming section 30D for yellow are arranged in a row in this order along the intermediate transfer belt 121.

Description will be made mainly of the image forming section 30A for black. Each of the image forming sections 30B to 30D for other colors has the same arrangement as the image forming section 30A.

The image forming section 30A includes the photosensitive drum 31A which is rotatable counterclockwise in FIG. 3. Around the photosensitive drum 31A, there are disposed the electrostatic charger device 32A, exposure unit 33A, developing device 10A, primary transfer roller 35A and cleaning unit 36A in this order in the direction of rotation of the photosensitive drum 31A. The primary transfer roller 35A is placed to face the photosensitive drum 31A across the intermediate transfer belt 121.

The electrostatic charger device 32A electrostatically charges a peripheral surface of the photosensitive drum 31A to a predetermined potential uniformly. Though the present embodiment uses a contact-type electrostatic charger device using a roller, an electrostatic charger device of the type using a charger or a brush may be used.

The exposure unit 33A irradiates the photosensitive drum 31A with a laser beam modulated according to the image data item for black. A portion of the peripheral surface of the photosensitive drum 31A that is irradiated with the laser beam loses its electric potential by the photoconductive action of a photosensitive layer, to form an electrostatic latent image corresponding to the image data item for black. The photosensitive drums 31B to 31D each form an electrostatic latent image corresponding to a respective one of the image data items for cyan, magenta and yellow. The exposure unit 33A may comprise a laser scanning unit (LSU) or a writing device having an array of light-emitting devices such as ELs or LEDs.

The developing device 10A, which contains a black toner therein, has the developing roller 11A. The developing roller 11A feeds the developer to a developing region in which the peripheral surface of the photosensitive drum 31A and the peripheral surface of the developing roller 11A face each other and which allows toner particles to migrate to the peripheral surface of the photosensitive drum 31A. The developing device 10A supplies the toner to the electrostatic latent image formed on the peripheral surface of the photosensitive drum 31A to visualize the electrostatic latent image into a toner image.

The developing devices 10B to 10D, each of which contains a respective one of cyan, magenta and yellow toners, visualize the electrostatic latent images for the respective colors formed on the respective photosensitive drums 31B to 31D into cyan, magenta and yellow toner images.

In the present embodiment, the toner is electrostatically charged to have the same polarity as the surface potential of the photosensitive drum 31A. The polarity of the surface potential of the photosensitive drum 31A and the polarity of the toner charged are both negative.

The primary transfer roller 35A is applied with a primary transfer bias voltage having a polarity opposite to the polarity of the toner charged in order to transfer the toner image carried on the peripheral surface of the photosensitive drum 31A to the intermediate transfer belt 121. (In the present embodiment, the polarity of the primary transfer bias voltage is positive.) Thus, the black toner image formed on the photosensitive drum 31A is transferred to the intermediate transfer belt 121 so as to be superimposed upon the toner images of other colors on the intermediate transfer belt 121. The toner images of the respective colors are transferred to the intermediate transfer belt 121 by the respective image forming sections 30A to 30D so as to be superimposed one upon another, thereby forming a full-color toner image on the intermediate transfer belt 121.

When image data items for some of yellow, magenta, cyan and black are inputted, only those photosensitive drums for the colors associated with the image data items thus inputted form electrostatic latent images and then their respective toner images. In a monochrome printing mode, for example, only the photosensitive drum 31A for black forms an electrostatic latent image and then its toner image, while the intermediate transfer belt 121 receives only the black toner image transferred thereto.

The cleaning unit 36A collects residual toner remaining on the peripheral surface of the photosensitive drum 31A after the primary transfer operation following the developing operation.

The secondary transfer roller 140 is placed so as to face the driven roller 123 across the intermediate transfer belt 121. A recording sheet fed from the sheet feeding tray 110 passes between the secondary transfer roller 140 and the intermediate transfer belt 121. The secondary transfer roller 140 is applied with a secondary transfer bias voltage having a polarity opposite to the polarity of the toner charged. (In the present embodiment, the polarity of the secondary transfer bias voltage is positive.) Thus, the full-color toner image formed on the intermediate transfer belt 121 is transferred to the recording sheet passing between the intermediate transfer belt 121 and the secondary transfer roller 140.

The fixing device 150 has a heating roller 151 and a pressurizing roller 152. The recording sheet bearing the toner image transferred thereto is guided to the fixing device 150 and then heated and pressurized when the recording sheet passes between the heating roller 151 and the pressurizing roller 152. Thus, the toner image is firmly fixed to the surface of the recording sheet. The recording sheet bearing the toner image fixed thereto is ejected onto a non-illustrated catch tray.

Figure 4:
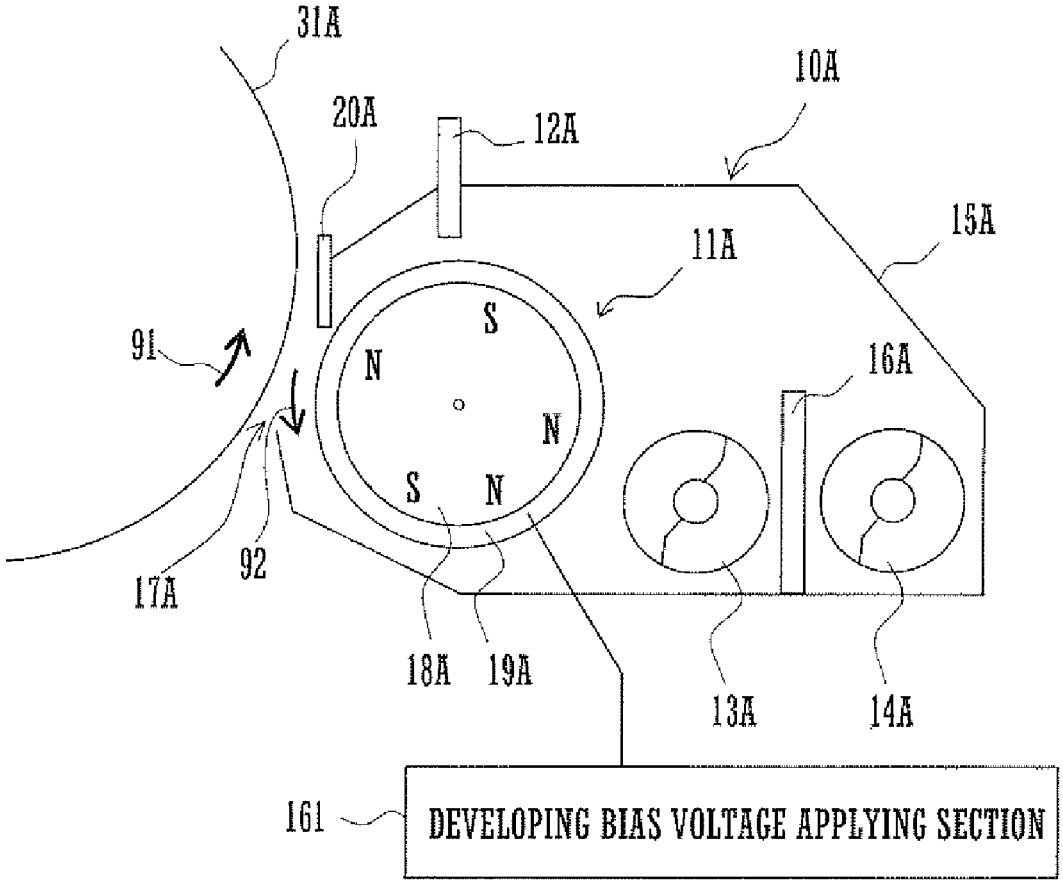
FIG. 4 is a sectional front elevational view of the developing device.

FIG. 4 is a sectional front elevational view of the developing device 10A. The other developing devices 10B to 10D each have the same arrangement as the developing device 10A.

The developing device 10A includes, in addition to the developing roller 11A, a layer thickness restricting blade 12A, two stirring and feeding screws 13A and 14A, a developing tank 15A, and a spike-height restricting blade 20A. The layer thickness restricting blade 12A is equivalent to a layer thickness restricting member. The spike-height restricting blade 20A is equivalent to a spike-height restricting member.

The developing tank 15A stores therein the two-component developer comprising the toner and the carrier. The stirring and feeding screws 13A and 14A are placed within the developing tank 15A. A partition wall 16A intervenes between the stirring and feeding screws 13A and 14A. The partition wall 16A separates a region around the stirring and feeding screw 13A and a region around the stirring and feeding screw 14A from each other except spaces in the vicinity of opposite ends of each of the stirring and feeding screws 13A and 14A along the axis of rotation.

The toner contained in the developer stored in the developing tank 15A is stirred together with the carrier by the stirring actions of the stirring and feeding screws 13A and 14A, thereby being frictionally electrified.

The developing tank 15A has an opening 17A in a portion facing the photosensitive drum 31A. The developing roller 11A is positioned within the developing tank 15A so as to be partially exposed through the opening 17A of the developing tank 15A and to define a predetermined developing gap with the peripheral surface of the photosensitive drum 31A. The developing gap is a spacing set as desired within a range from about 0.3 mm to about 1.0 mm for example. Usually, the developing gap is preferably as small as possible, for example, within a range from 0.3 mm to 0.5 mm.

The developing roller 11A has a magnet roller 18A and a non-magnetic developing sleeve 19A. The magnetic roller 18A is equivalent to a magnetic field generating member. The developing sleeve 19A is equivalent to a developer bearing member. The magnet roller 18A has a plurality of magnetic poles including a main magnetic pole positioned in the vicinity of the developing region. The plurality of magnetic poles are arranged circumferentially of the magnet roller 18A. The magnet roller 18A is fixed to the developing tank 15A. The developing sleeve 19A is shaped substantially cylindrical and formed from an aluminum alloy, brass or the like. The developing sleeve 19A is fitted over the magnet roller 18A so as to be rotatable in a predetermined direction. The developing sleeve 19A is rotated by a non-illustrated driving source in such a direction as to feed the developer at the developing region in a predetermined feeding direction 92. The feeding direction 92 is equivalent to the second direction defined by the technology.

The photosensitive drum 31A rotates in such a direction as to feed the electrostatic latent image at the developing region in a predetermined direction 91. The feeding direction 91 is equivalent to a first direction. The image forming apparatus 100 employs the counter developing system wherein the feeding direction 92 in which the developing sleeve 19A feeds the developer at the developing region is opposite to the feeding direction 91 in which the photosensitive drum 31A feeds the electrostatic latent image at the developing region.

The carrier contained in the developer comprises a magnetic material. Toner particles adhere to the surface of the carrier by the Coulomb force resulting from frictional electrification. The developer is attracted onto the peripheral surface of the developing sleeve 19A by magnetic fields generated by the magnetic poles of the magnet roller 18A, to form a magnetic brush. The developer is fed into the developing region by rotation of the developing sleeve 19A.

The layer thickness restricting blade 12A is attached to the developing tank 15A at a predetermined position upstream of the opening 17A in the developer feeding direction 92 in such a manner that the tip thereof faces the peripheral surface of the developing sleeve 19A. The layer thickness restricting blade 12A restricts the layer thickness of the developer attracted on the peripheral surface of the developing sleeve 19A.

The spike-height restricting blade 20A is supported on the developing tank 15A at a predetermined position upstream of a proximal position at which the peripheral surface of the photosensitive drum 31A and the peripheral surface of the developing sleeve 19A are closest to each other and downstream of the layer thickness restricting blade 12A in the developer feeding direction 92 in such a manner that the tip thereof faces the peripheral surface of the developing sleeve 19A. The spike-height restricting blade 20A restricts the spike height of the developer caused to project like spikes on the peripheral surface of the developing sleeve 19A under a magnetic field generated by the main magnetic pole of the magnet roller 18A. The spike height of the developer projecting like spikes is about 1.2 mm before restriction by the spike-height restricting blade 20A. Such spikes of the developer are cut to the same height, for example, 0.6 mm by restriction by the spike-height restricting blade 20A. The spike-height restricting blade 20A will be described in detail later.

The image forming apparatus 100 further includes a developing bias voltage applying section 161. The developing bias voltage applying section 161 applies a developing bias voltage to the developing sleeve 19A so that the potential difference between the developing sleeve 19A and the photosensitive drum 31A varies continuously and periodically.

The developing bias voltage is a voltage comprising a direct current component and an alternating current component which are superposed upon each other, that is, an oscillating bias voltage such that a developing potential and a reverse developing potential alternate with each other. The developing potential exerts a force on the electrostatically charged toner in a direction from the developing roller 11A toward the photosensitive drum 31A. The reverse developing potential exerts a force on the electrostatically charged toner in a direction from the photosensitive drum 31A toward the developing roller 11A. Toner particles fed into the developing region are caused to fly between the developing sleeve 19A and the photosensitive drum 31A by the developing bias voltage. For example, the developing bias voltage applying section 161 applies the developing sleeve 19A with a rectangular wave oscillating bias voltage having a frequency of 9 kHz and an amplitude of 0.8 kV.

The developing device 10A feeds the developer into the developing region at a predetermined feed rate per unit time. The toner contained in the developer fed into the developing region is attracted to the electrostatic latent image carried on the peripheral surface of the photosensitive drum 31A by electrostatic force. Thus, the electrostatic latent image is developed into the toner image.

The developing device 10A feeds the carrier and residual toner, which has not been used for development, of the developer fed to the developing region back into the developing tank 15A by rotation of the developing sleeve 19A.

Detailed description will be made of the spike-height restricting blade 20A. The spike-height restricting blade 20A is formed from a non-magnetic resin having elasticity such as urethane, PET (polyethylene terephthalate), or the like.

Since the spike-height restricting blade 20A is formed from the non-magnetic material, the magnetic field in the developing region can be prevented from being disturbed by the spike-height restricting blade 20A, unlike in the case where the spike-height restricting blade is formed from a magnetic material.

Also, since the spike-height restricting blade 20A is formed from the resin having elasticity, the spike-height restricting blade 20A can be placed in such a position that the tip thereof contacts the peripheral surface of the developing sleeve 19A. For this reason, the spike-height restricting blade 20A can be attached easily and positioned stably. Further, since the spike-height restricting blade 20A has elasticity, the spike-height restricting blade 20A is caused to float up from the peripheral surface of the developing sleeve 19A by the developer fed thereto and, hence, the developer is fed in such a manner as to slip through the gap between the peripheral surface of the developing sleeve 19A and the spike-height restricting blade 20A.

The spike-height restricting blade 20A may be formed from a metal. In cases where the spike-height restricting blade 20A is formed from a hard material such as a metal, the spike-height restricting blade 20A needs to be fixed firmly at a position adjacent the peripheral surfaces of respective of the developing sleeve 19A and the photosensitive drum 31A so as not to contact both of the peripheral surfaces. This is because the spike-height restricting blade 20A of metal, when contacting the peripheral surface of the developing sleeve 19A, prevents the developer from being fed into the developing region and because the spike-height restricting blade 20A of metal, when contacting the peripheral surface of the photosensitive drum 31A, might disorder the electrostatic latent image. In the present embodiment, the spike-height restricting blade 20A comprises a PET film having a thickness of 0.1 mm and has a tip brought into contact with the peripheral surface of the developing sleeve 19A.

Figure 5:
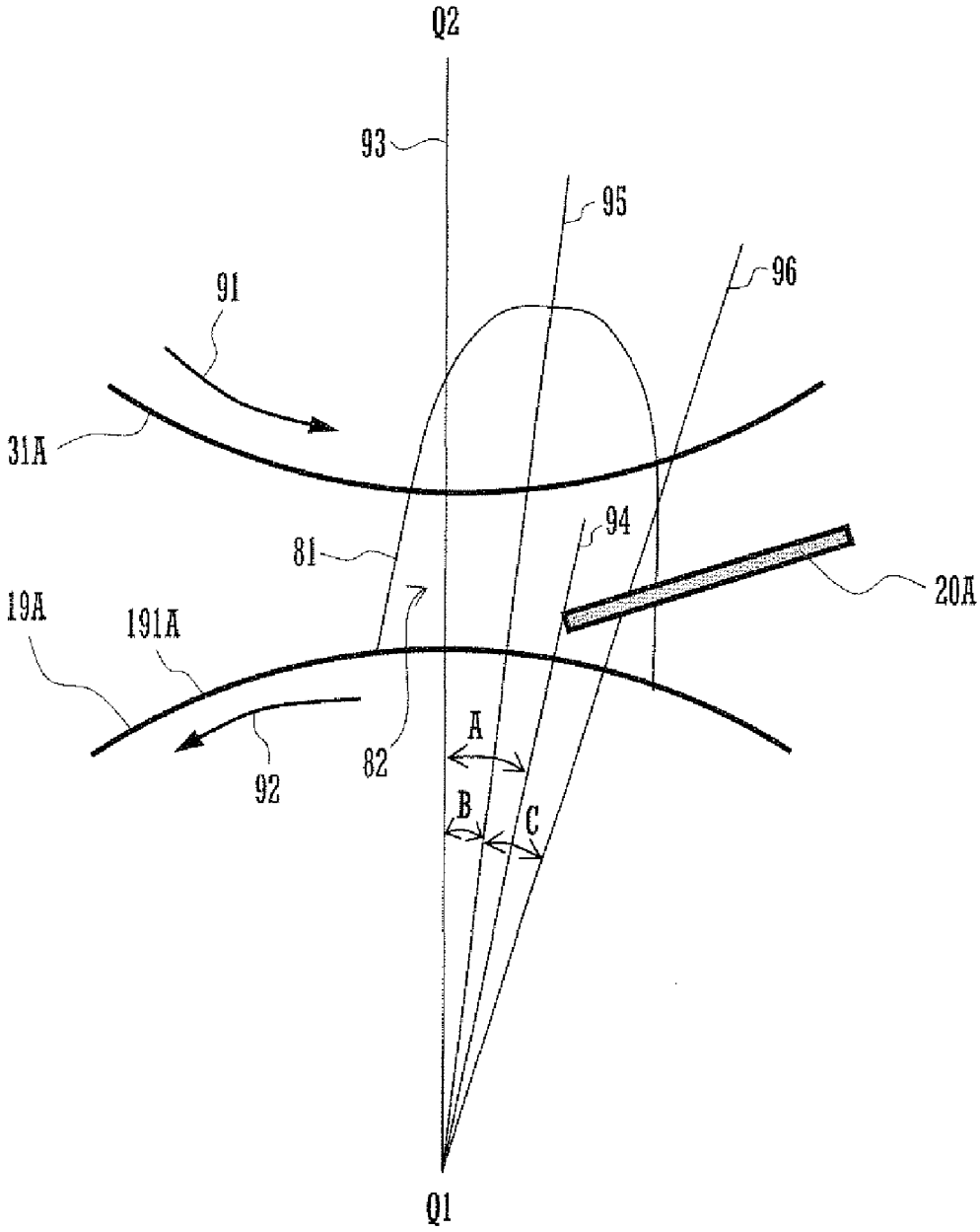
FIG. 5 is a view illustrating the position of a spike-height restricting blade included in the developing device.

FIG. 5 is a view illustrating the position of the spike-height restricting blade 20A included in the developing device 10A. The spike height of the developer projecting like spikes on the peripheral surface of the developing sleeve 19A can be adjusted by adjusting the position of the tip of the spike-height restricting blade 20A.

Reference line 93 shown in FIG. 5 is a line linking a rotation center Q1 of the developing sleeve 19A and a rotation center Q2 of the photosensitive drum 31A. First line 94 is a line liking the rotation center Q1 and the tip of the spike-height restricting blade 20A. Angle A is an angle defined between the reference line 93 and the first line 94 circumferentially of peripheral surface 191A of the developing sleeve 19A.

Second line 95 is a line linking the rotation center Q1 and a circumferential position on the peripheral surface 191A at which the intensity of a magnetic field 81 generated at the peripheral surface 191A by the main magnetic pole assumes a maximum value in a radial direction of the developing sleeve 19A. Angle B is an angle defined between the reference line 93 and the second line 95 circumferentially of the peripheral surface 191A.

Third line 96 is a line linking the rotation center Q1 and a circumferential position on the peripheral surface 191A which is located upstream of the second line 95 in the developer feeding direction 92 and at which the intensity of the magnetic field 81 generated at the peripheral surface 191A by the main magnetic pole is a half of the maximum value in the radial direction of the developing sleeve 19A. Angle C is an angle defined between the second line 95 and the third line 96 circumferentially of the peripheral surface 191A. Under this condition, the following formula holds:

$$A \leqq B+C.$$

In brief, the tip of the spike-height restricting blade 20A is positioned within a region between proximal position 82 at which the photosensitive drum 31A and the developing sleeve 19A are closest to each other and the circumferential position on the peripheral surface 191A at which the intensity of the magnetic field 81 generated at the peripheral surface 191A by the main magnetic pole is a half of the maximum value in the radial direction of the developing sleeve 19A and which is located upstream of the circumferential position on the peripheral surface 191A in the developer feeding direction 92 at which the intensity of the magnetic field 81 generated at the peripheral surface 191A by the main magnetic pole assumes the maximum value in the radial direction of the developing sleeve 19A.

In most cases, the developer is caused to project like spikes at a position downstream of the third line 96 in the developer feeding direction 92. For this reason, the developer is not caused to project like spikes in a region in which the formula: A>B+C holds. Therefore, if the tip of the spike-height restricting blade 20A is positioned within the region in which the formula: A>B+C holds, the spike height of the developer changes little.

Thus, by positioning the tip of the spike-height restricting blade 20A within the region in which the formula: A≦B+C holds, the spike height of the developer can be adjusted to a predetermined value.

Figure 6:
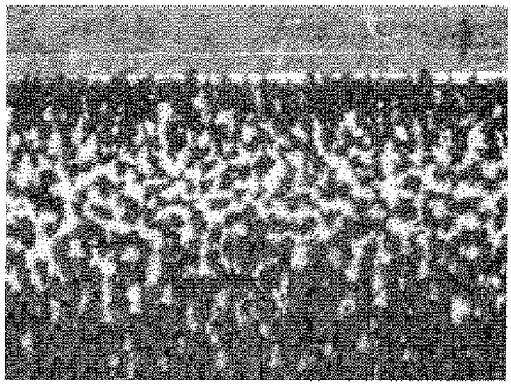
FIG. 6(A) is a photograph, taken from above a developing sleeve, of a developer projecting like spikes on a peripheral surface of the developing sleeve of the developing device provided with the spike-height restricting blade.
FIG. 6(B) is a photograph, taken transversely of the developing sleeve, of the developer projecting like spikes on the peripheral surface of the developing sleeve of the developing device provided with the spike-height restricting blade.
FIG. 6(C) is a photograph, taken from above a developing sleeve, of a developer projecting like spikes on a peripheral surface of the developing sleeve of a developing device not provided with the spike-height restricting blade.
FIG. 6(D) is a photograph, taken transversely of the developing sleeve, of the developer projecting like spikes on the peripheral surface of the developing sleeve of the developing device not provided with the spike-height restricting blade.
Figure 6:
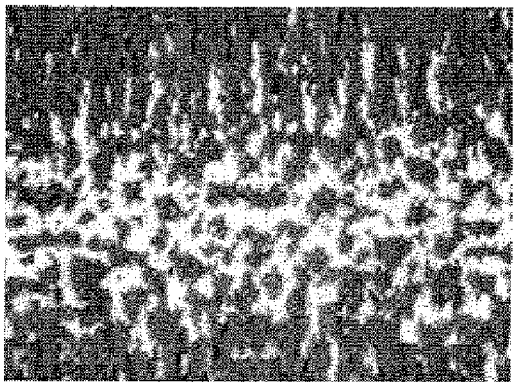
Figure 6:
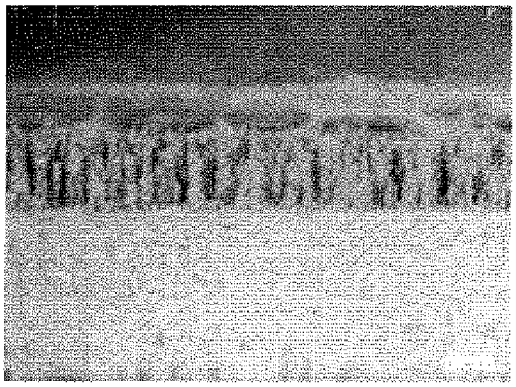
Figure 6:
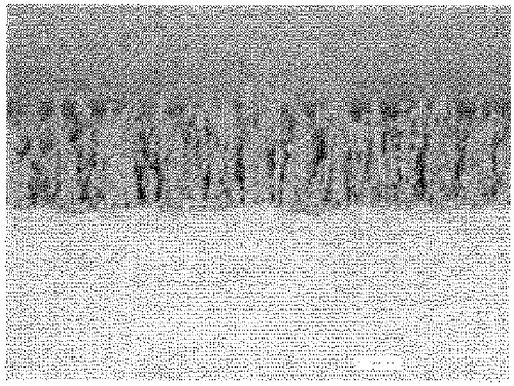

FIG. 6(A) is a photograph, taken from above the developing sleeve 19A, of the developer projecting like spikes on the peripheral surface 191A of the developing sleeve 19A of the developing device 10A provided with the spike-height restricting blade 20A. FIG. 6(B) is a photograph, taken transversely of the developing sleeve 19A, of the developer projecting like spikes on the peripheral surface 191A of the developing sleeve 19A of the developing device 10A provided with the spike-height restricting blade 20A. In FIGS. 6(A) and 6(B), the angles A and B are set to 7° and 0°, respectively.

FIGS. 6(C) and 6(D) shows a comparative example. FIG. 6(C) is a photograph, taken from above a developing sleeve, of the developer projecting like spikes on a peripheral surface of the developing sleeve of a developing device not provided with the spike-height restricting blade. FIG. 6(D) is a photograph, taken transversely of the developing sleeve, of the developer projecting like spikes on the peripheral surface of the developing sleeve of the developing device not provided with the spike-height restricting blade.

FIGS. 6(A) and 6(B) are the photographs each showing the state of the developer at a predetermined position downstream of the tip of the spike-height restricting blade 20A in the developer feeding direction 92. FIGS. 6(C) and 6(D) are the photographs each showing the state of the developer at a position equivalent to the predetermined position described above.

The carrier used in the present embodiment is formed from ferrite core and has an average particle diameter of 40 μm. The magnet roller 18A has a diameter of 18 mm and is configured such that: its main magnetic pole generates a magnetic field having a maximum intensity of 1100 mT in a radial direction of the developing sleeve 19A; and the angle C is set to 14°.

As can be seen from comparison between FIGS. 6(A) and 6(C) by observation, the developer shown in FIG. 6(A) had a higher density of projecting spikes than that shown in FIG. 6(C). This proves that by restricting the spike height of the developer with the spike-height restricting blade 20A, the density of projecting spikes of the developer was increased. As can be seen from comparison between FIGS. 6(B) and 6(D) by observation, the developer shown in FIG. 6(B) had a lower spike height than that shown in FIG. 6(D) and had spikes cut to a substantially even height. This proves that the spike-height restricting blade 20A lowered the spike height of the developer and cut the spikes to a substantially even height.

Figure 7:
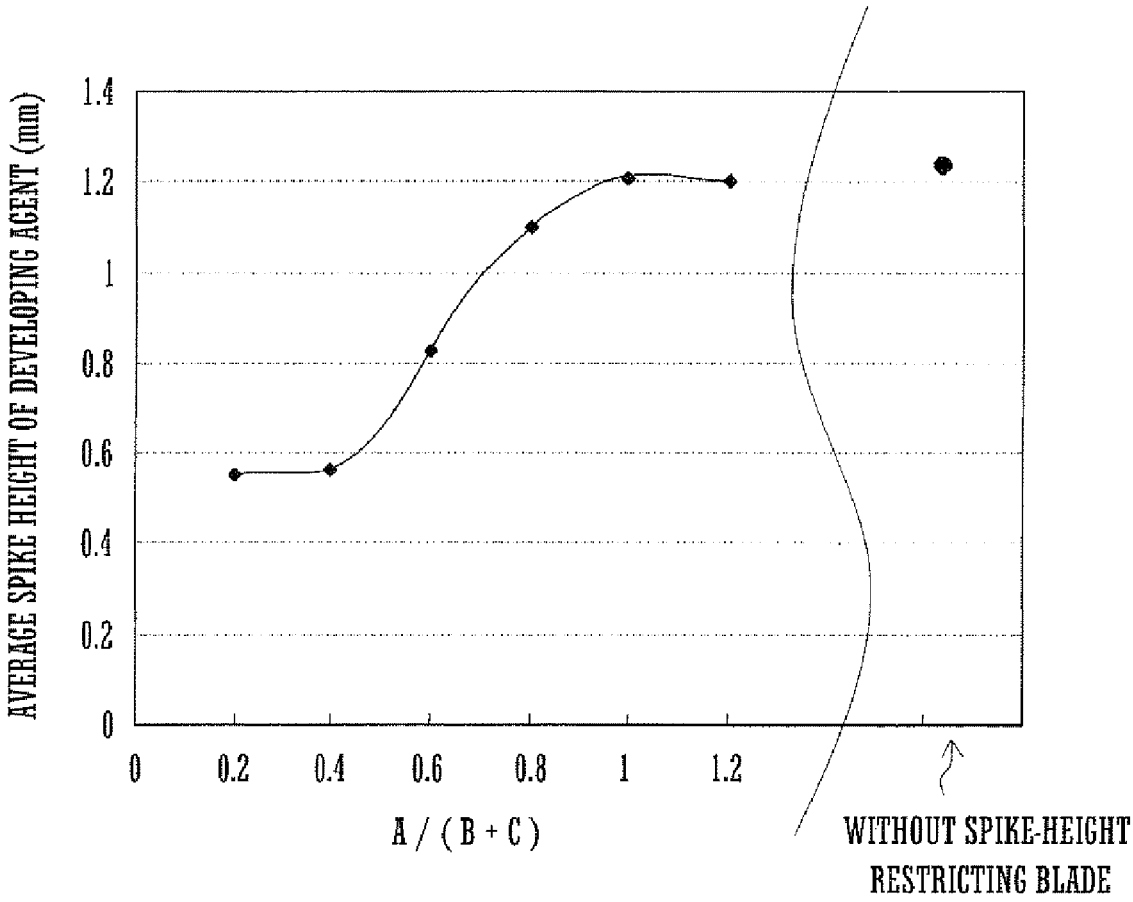
FIG. 7 is a graph plotting the relationship between the value of A/(B+C) and the average height of projecting spikes of the developer with varying angle A.

FIG. 7 is a graph plotting the relationship between the value of A/(B+C) and the average height of projecting spikes of the developer with varying angle A. In FIG. 7, the average height of projecting spikes of the developer represented by the vertical axis was a value obtained by averaging the heights of 100 spikes selected at random from a photograph taken transversely of the developing sleeve 19A as shown in FIG. 6(B).

As can be seen from FIG. 7, the spike height of the developer obtained when A/(B+C)=1 is slightly lower than that obtained in the case where the spike-height restricting blade 20A is not provided and, hence, the spike height is not restricted. As can be also seen from FIG. 7, the spike height of the developer obtained when A/(B+C)=1.2 is substantially equal to that obtained when A/(B+C)=1. These facts prove that the spike height of the developer obtained when A/(B+C)>1 changes little whether or not the spike-height restricting blade 20A is provided. On the other hand, the spike height of the developer is lowered by the spike-height restricting blade 20A when A/(B+C)≦1, i.e.,
A≦B+C. This proves that by positioning the tip of the spike-height restricting blade 20A within the region in which the formula: A≦B+C holds, the spike height of the developer can be restricted to a predetermined height.

If it is possible to increase the angle A defined circumferentially of peripheral surface 191A of the developing sleeve 19A between the reference line 93 linking the rotation center Q1 of the developing sleeve 19A and the rotation center Q2 of the photosensitive drum 31A and the first line 94 linking the rotation center Q1 and the tip of the spike-height restricting blade 20A, the spike-height restricting blade 20A can be positioned apart from the proximal position 82 at which the photosensitive drum 31A and the developing sleeve 19A are closest to each other (see FIG. 5). By so doing, the space within which the spike-height restricting blade 20A can be positioned is expanded for easy positioning of the spike-height restricting blade 20A.

An example of means for increasing the angle A is setting the angle B to B>0. Specifically, the main magnetic pole of the magnet roller 18A is positioned upstream of the proximal position 82 at which the photosensitive drum 31A and the developing sleeve 19A are closest to each other in the developer feeding direction 92. In the case where the hard material is used for the spike-height restricting blade 20A, the space within which the spike-height restricting blade 20A can be positioned is narrower than in the case where the resin material having elasticity is used for the spike-height restricting blade 20A. Setting the angle B to B>0 is particularly effective in such a case because the space within which the spike-height restricting blade 20A can be positioned is expanded by such a setting.

Detailed description will be made of the developing sleeve 19A. As described above, the developing sleeve 19A is applied with the developing bias voltage comprising a direct current component and an alternating current component which are superposed upon each other. If the developing bias voltage does not comprise the alternating current component and consists only of the direct current component, the amount of developer to contact the photosensitive drum 31A is reduced by an amount corresponding to a decrease in the spike height of the developer resulting from restriction with the spike-height restricting blade 20A, so that the resulting image has a lowered density. Further, since the feed rate of the developer per unit area of the peripheral surface 19A of the developing sleeve 19A is lowered due to the lowered spike-height of the developer, the developing bias voltage consisting only of the direct current component sometimes causes the developer to be fed non-uniformly. In the image forming apparatus 100, by contrast, the developing sleeve 19A is applied with the developing bias voltage comprising the direct current component and the alternating current component which are superposed upon each other and, hence, it is easy to supply the toner to the electrostatic latent image uniformly and sufficiently. Therefore, it is possible to provide the image with a proper density and prevent the image quality from lowering due to non-uniform feeding of the developer.

The peripheral surface of the developing sleeve 19A is sandblasted. The sandblasted peripheral surface of the developing sleeve 19A allows the developer to form a high density of spikes uniformly on the peripheral surface. This results in a high-quality image. Further, the sandblasted peripheral surface of the developing sleeve 19A feeds the developer at a lower feed rate per unit area than does a non-sandblasted smooth peripheral surface. For this reason, the ability of the spike-height restricting blade 20A to restrict the spike height of the developer can be prevented from lowering.

In the present embodiment, the peripheral surface of the developing sleeve 19A feeds the developer at a feed rate of 40 mg/cm$^2$. As described above, the spike-height restricting blade 20A is formed from the resin material having elasticity and has its tip brought into contact with the peripheral surface of the developing sleeve 19A. When the developer reaches the spike-height restricting blade 20A, the spike-height restricting blade 20A deflects in such a manner that the tip thereof floats up from the peripheral surface of the developing sleeve 19A. When the developer feed rate per unit area of the peripheral surface of the developing sleeve 19A is not more than 60 mg/cm$^2$, the gap between the floating tip of the spike-height restricting blade 20A and the peripheral surface of the developing sleeve 19A does not expand very much, with the result that the ability of the spike-height restricting blade 20A to restrict the spike height of the developer can be prevented from lowering. Therefore, the developer feed rate per unit area of the peripheral surface of the developing sleeve 19A is desirably not more than 60 mg/cm$^2$, more desirably not more than 40 mg/cm$^2$.

FIG. 8 is a table showing the relationship between the circumferential velocity ratio obtained by dividing the linear velocity of the peripheral surface of the developing sleeve 19A by the linear velocity of the peripheral surface of the photosensitive drum 31A and the condition of the developer during feeding. In FIG. 8, symbol "x" represents a bad condition, symbol "○" represents a good condition, and symbol " " represents a particularly good condition.

The counter developing system can provide the image with a higher density than the forward developing system in which the developing sleeve 19A feeds the developer at the developing region in the developer feeding direction 92 which is the same direction as the electrostatic latent image feeding direction 91 in which the photosensitive drum 31A feeds the electrostatic latent image at the developing region, for the reason that the counter developing system allows a significantly larger amount of developer to contact the electrostatic latent image at the developing region, and a like reason. Accordingly, even when the circumferential velocity ratio is lowered by reducing the number of rotations of the developing sleeve 19A, an image having an insufficient density is not likely to be formed. Therefore, by reducing the number of rotations of the developing sleeve 19A, the stress exerted on the developer by the layer thickness restricting blade 12A and the spike-height restricting blade 20A can be reduced, whereby deterioration of the developer can be suppressed.

As can be seen from FIG. 8, when the image forming apparatus 100 was subjected to a predetermined long-term continuous operation test at a circumferential velocity ratio of 1.9, particles of the developer agglomerated due to the stress exerted by the layer thickness restricting blade 12A and the like, thereby causing the developer to be fed in a bad condition. By contrast, when the test was conducted at a circumferential velocity ratio of 1.8, the developer was fed in a good condition. The developer was fed in a particularly good condition when the circumferential velocity ratio was 1.7.

When the circumferential velocity ratio is less than 1.0, the linear velocity of the peripheral surface of the developing sleeve 19A is lower than the linear velocity of the peripheral surface of the photosensitive drum 31A. As a result, unevenness in the spike height of the developer projecting like spikes on the peripheral surface of the developing sleeve 19A is likely to occur, which affects the image quality seriously. Therefore, the circumferential velocity ratio is desirably not less than 1.0. More desirably, the circumferential velocity ratio is not less than 1.3 because unevenness in the spike height of the developer is difficult to occur.

In view of the above, the circumferential velocity ratio is desirably not less than 1.0 and not more than 1.8, more desirably not less than 1.3 and not more than 1.8, further more desirably not less than 1.3 and not more than 1.7.

Figure 9:
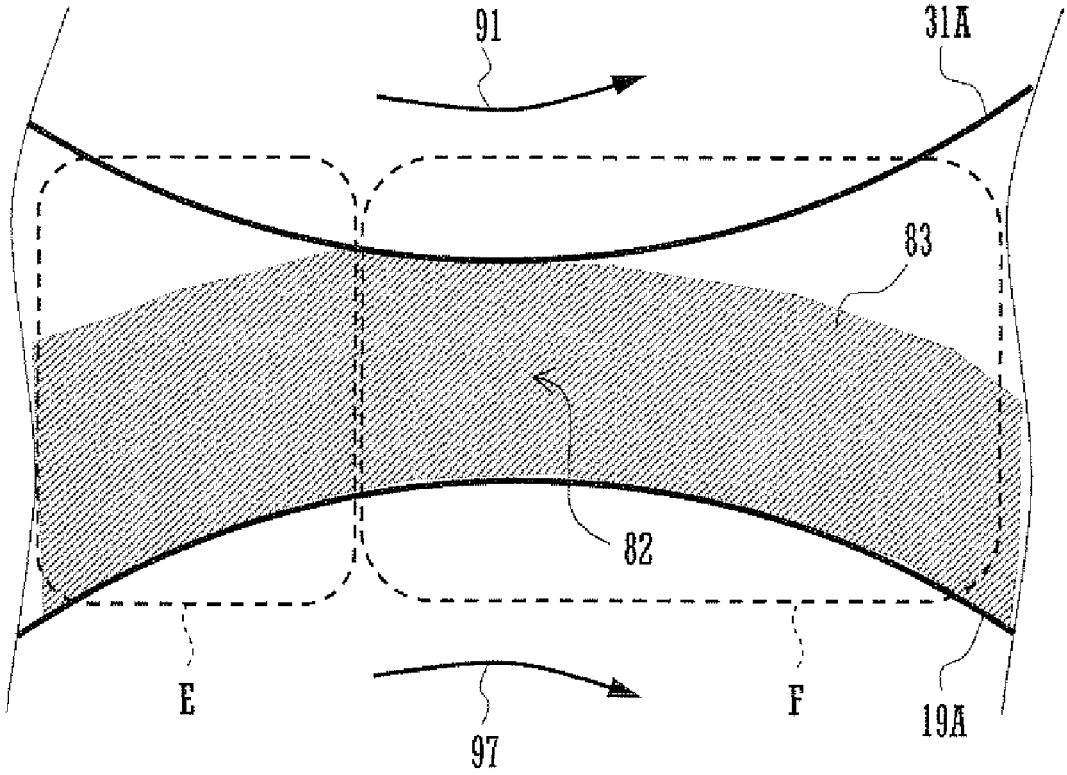
FIG. 9 is a front elevational view showing a developing region in an image forming apparatus including a developing device employing the forward developing system as a comparative example.
Figure 10:
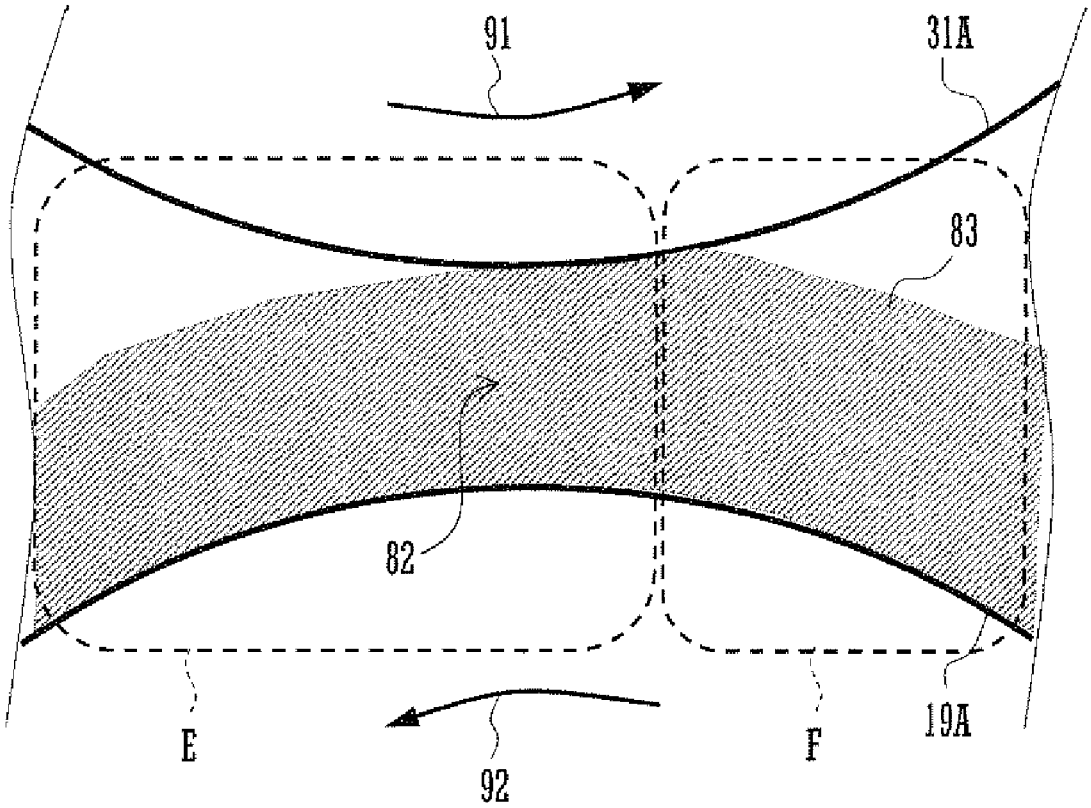
FIG. 10 is a front elevational view showing a developing region in an image forming apparatus including a developing device employing the counter developing system.

With reference to FIGS. 9 and 10, description will be made of the difference between the case where the spike-height restricting blade 20A is used in the forward developing system and the case where the spike-height restricting blade 20A is used in the counter developing system.

FIG. 9 is a front elevational view showing a developing region in an image forming apparatus including a developing device employing the forward developing system as a comparative example. In FIG. 9, like reference characters are used to designate like members common to the image forming apparatus 100 and the comparative example for convenience.

As described above, in the forward developing system, the developing sleeve 19A feeds the developer at the developing region in developer feeding direction 97 which is the same direction as the electrostatic latent image feeding direction 91 in which the photosensitive drum 31A feeds the electrostatic latent image at the developing region.

In the forward developing system, in general, the linear velocity of the peripheral surface of the developing sleeve 19A is higher than that of the peripheral surface of the photosensitive drum 31A and, hence, the developer 83 projecting like spikes on the peripheral surface of the developing sleeve 19A passes the electrostatic latent image on the photosensitive drum 31A.

In region E in which the developer 83 is in a state before contacting the peripheral surface of the photosensitive drum 31A, the spike height of the developer is restricted by the spike-height restricting blade 20A to a value that is slightly larger than the gap defined between the peripheral surface of the photosensitive drum 31A and that of the developing sleeve 19A at the proximal position 82. For this reason, the developer 83 fails to contact the peripheral surface of the photosensitive drum 31A in the region E and, hence, the developer is less susceptible to the potential of the peripheral surface of the photosensitive drum 31A. Thus, the potential of the developer exhibits high uniformity.

In region F which the developer 83 reaches after having contacted the peripheral surface of the photosensitive drum 31A, the spike height of the developer 83 becomes equal to the gap defined between the peripheral surface of the photosensitive drum 31A and that of the developing sleeve 19A at the proximal position 82. Since the tips of spikes of the developer 83 reaching the region F have contacted or passed close by the peripheral surface of the photosensitive drum 31A, the potential at the tips of the spikes of the developer 83 has been disturbed by the effect of the potential of the peripheral surface of the photosensitive drum 31A.

For example, when the tips of spikes of the developer 83 contact an image-free portion of the peripheral surface of the photosensitive drum 31A in which the electrostatic latent image is not formed, toner particles move back away from carrier particles at the tips of the spikes toward the spike root side, with the result that the tips of the spikes carry an electrical charge called "counter charge" having a polarity opposite to the normal polarity of the toner. When the developer 83 carrying the counter charge is fed into the region F, the toner image is disordered in the region F.

Even without the provision of the spike-height restricting blade 20A, the tips of spikes of the developer 83 pass through the proximal position 82 while contacting the peripheral surface of the photosensitive drum 31A. For this reason, the developer 83 often carries the counter charge in the region F.

The quality of the toner image tends to be determined in the region F, particularly on the downstream side of the proximal position 82 in the electrostatic latent image feeding direction 91. With the forward developing system, however, even in the case where the spike-height restricting blade 20A is provided, the developer 83 in the region F carries the counter charge as in the case where the spike-height restricting blade 20A is not provided. For this reason, the toner image is likely to be disordered in the region F. Therefore, with the forward developing system, a difference is not likely to occur in toner image quality between the case where the spike-height restricting blade 20A is provided and the case where the spike-height restricting blade 20A is not provided.

FIG. 10 is a front elevational view showing the developing region in the image forming apparatus 100 including the developing device 10A employing the counter developing system. As described above, in the counter developing system, the developing sleeve 19A feeds the developer at the developing region in the developer feeding direction 92 which is opposite to the electrostatic latent image feeding direction 91 in which the photosensitive drum 31A feeds the electrostatic latent image at the developing region.

In the case where the counter developing system is provided with the spike-height restricting blade 20A, the region F in which the developer 83 often carries the counter charge is located upstream of the proximal position 82 in the electrostatic latent image feeding direction 91. In the region E which is located downstream of the proximal position 82 in the electrostatic latent image feeding direction 91 and in which the quality of the toner image tends to be determined, the developer 83 does not carry the counter charge. Since the spike height of the developer 83 is restricted to an appropriate height by the spike-height restricting blade 20A in the region E, an excessive supply of toner to the electrostatic latent image is suppressed. For this reason, the toner image is rather restored than disordered in the region E. Therefore, the toner image quality is improved.

In the case where the counter developing system is not provided with the spike-height restricting blade 20A, the spikes of the developer 83 are relatively high in the region E and, hence, the developer 83 may contact the peripheral surface of the photosensitive drum 31A. For this reason, the toner image on the peripheral surface of the photosensitive drum 31A tends to be disordered. Accordingly, the toner image quality is lowered.

Thus, the spike-height restricting blade 20A exhibits little effect in the forward developing system. It is in the counter developing system that the spike-height restricting blade 20A exhibits the effect of improving the image quality.

Figure 11:
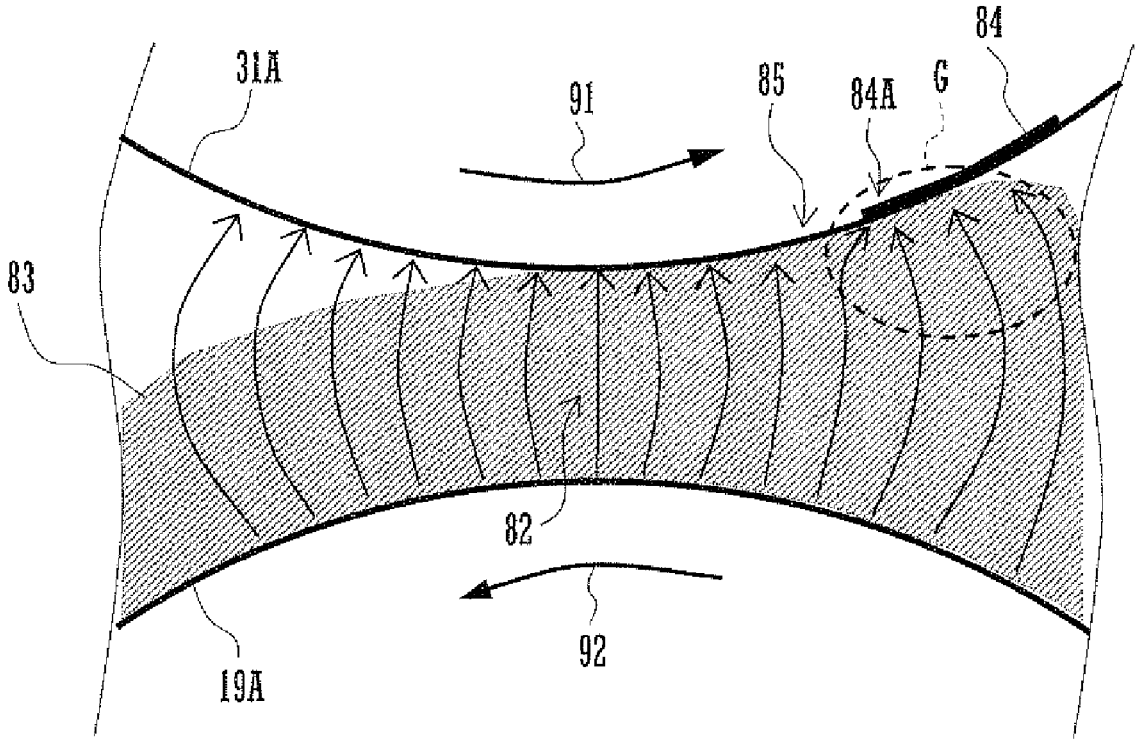
FIG. 11 is a front elevational view showing a developing region in an image forming apparatus including a developing device employing the counter developing system not provided with the spike-height restricting blade as a comparative example.
Figure 12:
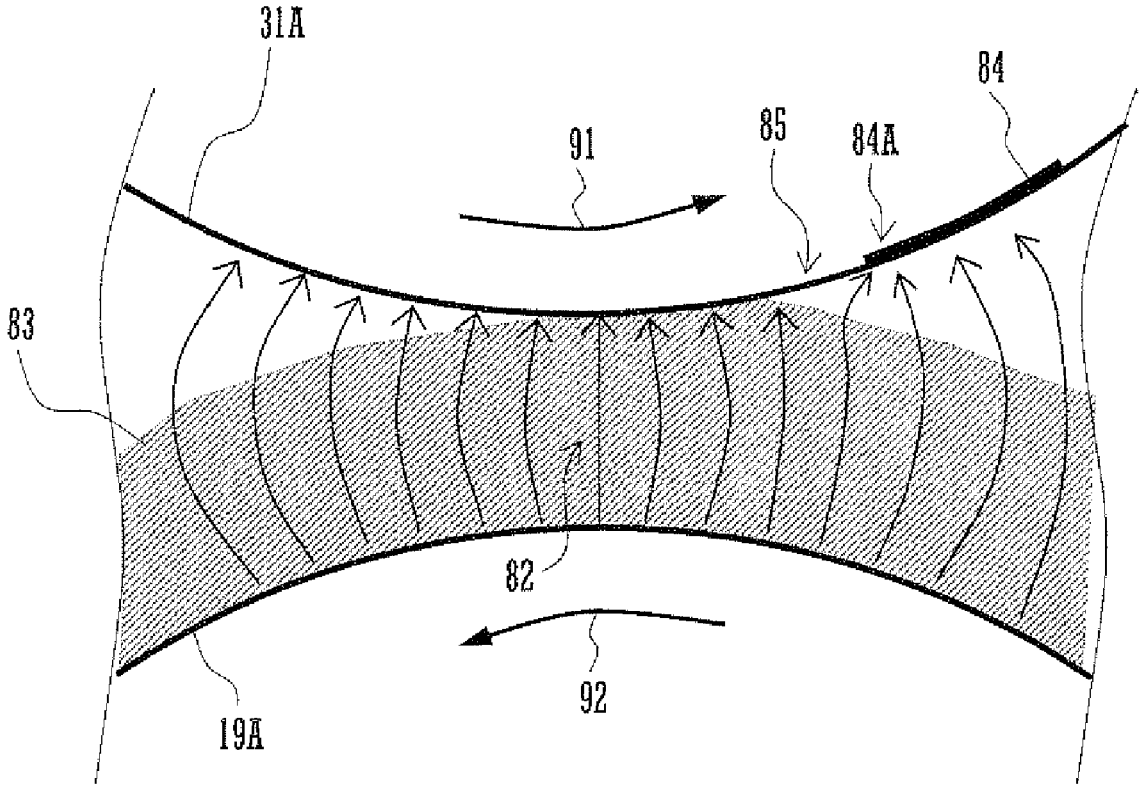
FIG. 12 is a front elevational view showing a developing region in an image forming apparatus including a developing device employing the counter developing system provided with the spike-height restricting blade.

With reference to FIGS. 11 and 12, description will be made of the difference between the case where the counter developing system is provided with the spike-height restricting blade 20A and the case where the counter developing system is not provided with the spike-height restricting blade 20A.

FIG. 11 is a front elevational view showing a developing region in an image forming apparatus including a developing device employing the counter developing system not provided with the spike-height restricting blade 20A as a comparative example. FIG. 12 is a front elevational view showing the developing region in the image forming apparatus 100 including the developing device 10A employing the counter developing system provided with the spike-height restricting blade 20A. In FIGS. 11 and 12, arrows extending from the peripheral surface of the developing sleeve 19A toward the peripheral surface of the photosensitive drum 31A indicate electric flux lines.

In the case where the developing device is not provided with the spike-height restricting blade 20A, in general, the spike height of the developer 83 is larger than the gap defined between the peripheral surface of the photosensitive drum 31A and the peripheral surface of the developing sleeve 19A at the proximal position 82 because the spike height of the developer 83 is not restricted on the upstream side of the proximal position 82 in the developer feeding direction 92, as shown in FIG. 11. For this reason, the tips of spikes of the developer 83 collide with the peripheral surface of the photosensitive drum 31A on the upstream side of the proximal position 82 in the developer feeding direction 92 to cause toner particles adhering to the carrier to float in a region G adjacent to the peripheral surface of the photosensitive drum 31A.

The developer 83 having collided with the peripheral surface of the photosensitive drum 31A is further fed to pass through the proximal position 82. The spike height of the developer 83 is restricted to a lower height when the developer 83 passes through the proximal position 82. The developer 83 is fed further downstream in the feeding direction 92.

As described above, the quality of the toner image tends to be determined on the downstream side of the proximal position 82 in the electrostatic latent image feeding direction 91. In the counter developing system, the region located downstream of the proximal position 82 in the electrostatic latent image feeding direction 91 is the region located upstream of the proximal position 82 in the developer feeding direction 92 in which the tips of spikes of the developer 83 collide with the peripheral surface of the photosensitive drum 31A.

Since trailing end portion 84A of electrostatic latent image 84 is located adjacent to image-free portion 85, the density of electric flux lines directed from the peripheral surface of the developing sleeve 19A toward the peripheral surface of the photosensitive drum 31A tends to increase in the trailing end portion 84A of the electrostatic latent image 84 in the electrostatic latent image feeding direction 91. Therefore, floating toner particles are likely to collect in the trailing end portion 84A of the electrostatic latent image 84. For this reason, in the case where the developing device is not provided with the spike-height restricting blade 20A, the phenomenon so-called "sweeping together" that the trailing end portion 84A of the electrostatic latent image 84 in the electrostatic latent image feeding direction 91 is developed excessively densely, is likely to occur.

Figure 13A:
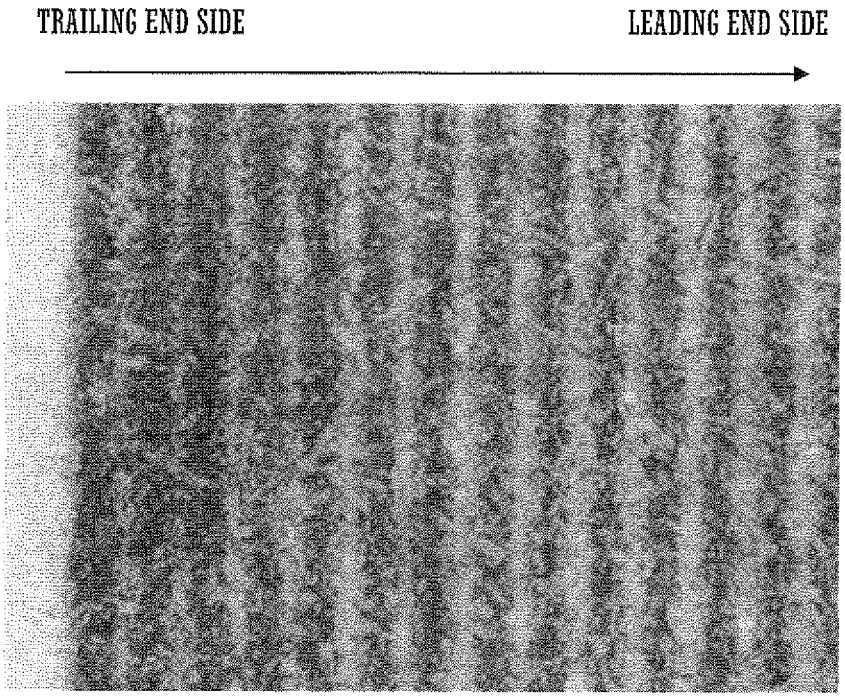
FIG. 13(A) is a view showing an image comprising plural lines which is formed by the image forming apparatus including the developing device employing the counter developing system not provided with the spike-height restricting blade as a comparative example.

FIG. 13(A) is a view showing an image comprising plural lines which is formed by the image forming apparatus including the developing device employing the counter developing system not provided with the spike-height restricting blade 20A as a comparative example. Lines in the trailing end portion of the image are excessively dense and each widened to such an extent as to contact an adjacent line.

As shown in FIG. 12, the image forming apparatus 100 including the developing device employing the counter developing system provided with the spike-height restricting blade 20A restricts, at a position upstream of the proximal position 82 in the developer feeding direction 92, the spike height of the developer 83 to a value slightly larger than the gap defined between the peripheral surface of the photosensitive drum 31A and the peripheral surface of the developing sleeve 19A at the proximal position 82. Therefore, the spikes of the developer 83 can hardly collide with the peripheral surface of the photosensitive drum 31A at the position upstream of the proximal position 82 in the developer feeding direction 92 and, hence, toner particles can hardly float.

Thus, the image forming apparatus 100 including the developing device 10A employing the counter developing system provided with the spike-height restricting blade 20A is capable of suppressing the occurrence of the phenomenon that the trailing end portion 84A of the electrostatic latent image 84 is developed excessively densely, at the position upstream of the proximal position 82 in the developer feeding direction 92, i.e., at the position downstream of the proximal position 82 in the electrostatic latent image feeding direction 91.

Figure 13B:
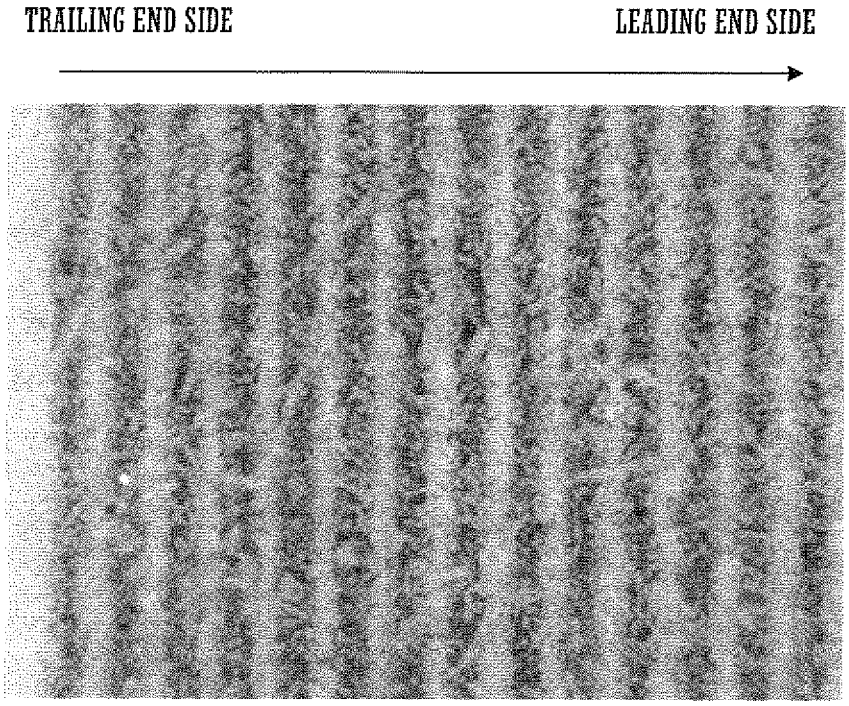
FIG. 13(B) is a view showing an image comprising plural lines which is formed by the image forming apparatus including the developing device employing the counter developing system provided with the spike-height restricting blade.

FIG. 13(B) is a view showing an image comprising plural lines which is formed by the image forming apparatus including the developing device 10A employing the counter developing system provided with the spike-height restricting blade 20A. In the trailing end portion of the image, the density and width of each line are not increased and the spacing between adjacent lines is not narrowed. Any portion having a pinhole, in particular, is not observed.

Thus, in the image forming apparatus including the developing device employing the counter developing system, the spike-height restricting blade 20A restricts the spike height of the developer 83 caused to project like spikes under the magnetic field generated by the main magnetic pole at the position upstream of the proximal position 82 in the developer feeding direction 92, thereby making it possible to suppress the occurrence of a pinhole in the halftone region developed prior to the high density region as well as the occurrence of the phenomenon that the trailing end portion of the image becomes excessively dense.

The foregoing embodiment is illustrative in all points and should not be construed to limit the technology. The scope of the technology is defined not by the foregoing embodiment but by the following claims. Further, the scope is intended to include all modifications within the scopes of the claims and within the meanings and scopes of equivalents.

What is claimed is:

1. A developing device for developing an electrostatic latent image carried on an electrostatic latent image bearing member that is rotating in a first rotational direction so that a peripheral surface thereof is moving in a first linear direction, the developing device comprising:

a developer bearing member having a substantially cylindrical shape and configured to be positioned adjacent to the electrostatic latent image bearing member and that rotates in the first rotational direction so that a peripheral surface of the developer bearing member adjacent to the surface of the electrostatic latent image bearing member is moving in a second linear direction which is opposite to the first linear direction, the peripheral surface bearing developer and feeding the developer to the electrostatic latent image bearing member at a developing region in which the developer bearing member faces the electrostatic latent image bearing member;

a magnetic field generating member unrotatably placed inside the developer bearing member and having a plurality of magnetic poles including a main magnetic pole positioned in the vicinity of the developing region;

a layer thickness restricting member configured to restrict a layer thickness of the developer on the peripheral surface of the developer bearing member at a position upstream of the developing region in the second linear direction; and a spike-height restricting member having a tip located upstream of a proximal position in the second linear direction, the proximal position being a position at which the electrostatic latent image bearing member and the developer bearing member are located closest to each other, the tip also being located downstream in the second linear direction of a first circumferential position on the peripheral surface of the developer bearing member at which an intensity of a magnetic field generated by the main magnetic pole assumes a half of the maximum value in the radial direction of the developer bearing member, the spike-height restricting member restricting a height of spikes of the developer on the peripheral surface of the developer bearing member which are caused by a magnetic field generated by the main magnetic pole.

2. The developing device according to claim 1, wherein the spike-height restricting member is formed from a resin.

3. The developing device according to claim 1, wherein the main magnetic pole is positioned upstream of the proximal position in the second linear direction.

4. The developing device according to claim 1, wherein the peripheral surface is sandblasted.

5. The developing device according to claim 1, wherein the developer bearing member is applied with a developing bias voltage comprising a direct current component and an alternating current component which are superposed upon each other.

6. The developing device according to claim 1, wherein the first circumferential position is positioned upstream of a second circumferential position on the peripheral surface of the developer bearing member in the second linear direction, the second circumferential position being a position at which an intensity of the magnetic field generated by the main magnetic pole assumes a maximum value in the radial direction of the developer bearing member.

7. The developing device according to claim 1, wherein a circumferential velocity ratio obtained by dividing a linear velocity of the peripheral surface of the developer bearing member by a linear velocity of a surface of the electrostatic latent image bearing member is not less than 1.3 and not more than 1.8.

8. An image forming apparatus comprising:

an electrostatic latent image bearing member configured to feed an electrostatic latent image at a developing region in the first linear direction; and the developing device recited in claim 1.

9. The developing device according to claim 1, wherein the tip of the spike-height restricting member does not contact a surface of the electrostatic latent image bearing member.

10. The developing device according to claim 1, wherein the tip of the spike-height restricting member is located between the proximal position and the first circumferential position.

11. A developing device for developing an electrostatic latent image carried on an electrostatic latent image bearing member that is rotating in a first rotational direction so that a peripheral surface thereof is moving in a first linear direction, the developing device comprising:

a developer bearing member having a substantially cylindrical shape and configured to be positioned adjacent to the electrostatic latent image bearing member and that rotates in the first rotational direction so that a peripheral surface of the developer bearing member adjacent to the surface of the electrostatic latent image bearing member is moving in a second linear direction which is opposite to the first linear direction, the peripheral surface bearing developer and feeding the developer to the electrostatic latent image bearing member at a developing region in which the developer bearing member faces the electrostatic latent image bearing member;

a magnetic field generating member unrotatably placed inside the developer bearing member and having a plurality of magnetic poles including a main magnetic pole positioned in the vicinity of the developing region;

a layer thickness restricting member configured to restrict a layer thickness of the developer on the peripheral surface of the developer bearing member at a position upstream of the developing region in the second linear direction; and a spike-height restricting member having a tip located upstream of a proximal position in the second linear direction, the proximal position being a position at which the electrostatic latent image bearing member and the developer bearing member are located closest to each other, the tip being located downstream of the layer thickness restricting member in the second linear direction, the spike-height restricting member restricting a height of spikes of the developer on the peripheral surface of the developer bearing member which are caused by a magnetic field generated by the main magnetic pole, and wherein a circumferential velocity ratio obtained by dividing a linear velocity of the peripheral surface of the developer bearing member by a linear velocity of a surface of the electrostatic latent image bearing member is not less than 1.3 and not more than 1.8.

12. A developing device according to claim 11, wherein the tip of the spike-height restricting member does not contact a surface of the electrostatic latent image bearing member.

13. A developing device according to claim 11, wherein the tip of the spike-height restricting member is located downstream in the second direction from a circumferential position on the peripheral surface of the developer bearing member at which an intensity of the magnetic field generated by the main magnetic pole is a half of a maximum value in a radial direction of the developer bearing member.

14. An image forming apparatus, comprising:

an electrostatic latent image bearing member that is rotating in a first rotational direction;

a developer bearing member having a substantially cylindrical shape that is positioned adjacent to the electrostatic latent image bearing member and that rotates in the first rotational direction such that at a developing region where the developer bearing member faces the electrostatic latent image bearing member, a surface of the electrostatic latent image bearing member moves in a first linear direction and a surface of the developer bearing member moves in a second linear direction that is opposite the first linear direction;

a magnetic field generating member unrotatably placed inside the developer bearing member and having a plurality of magnetic poles including a main magnetic pole positioned in the vicinity of the developing region;

a layer thickness restricting member configured to restrict a layer thickness of the developer on the peripheral surface of the developer bearing member at a position upstream of the developing region in the second linear direction; and a spike-height restricting member having a tip located downstream of the layer thickness restricting member in the second linear direction wherein the spike-height restricting member restricts a height of spikes of the developer on the peripheral surface of the developer bearing member which are caused by a magnetic field generated by the main magnetic pole, and wherein the tip of the spike-height restricting member is not in contact with the surface of the electrostatic latent image bearing member.

15. The image forming apparatus according to claim 14, wherein a circumferential velocity ratio obtained by dividing a linear velocity of the peripheral surface of the developer bearing member by a linear velocity of the surface of the electrostatic latent image bearing member is not less than 1.3 and not more than 1.8.

16. The image forming apparatus according to claim 14, wherein the tip of the spike-height restricting member is located downstream in the second linear direction from a first circumferential position on the peripheral surface of the developer bearing member at which an intensity of the magnetic field generated by the main magnetic pole is a half of a maximum value in a radial direction of the developer bearing member.

17. The image forming apparatus according to claim 16, wherein the first circumferential position is located upstream in the second linear direction from a second circumferential position on the peripheral surface of the developer bearing member at which an intensity of the magnetic field generated by the main magnetic pole is maximum in a radial direction of the developer bearing member.

* * * * *